US005467569A

United States Patent [19]

Chiodo

[11] Patent Number: 5,467,569

[45] Date of Patent: Nov. 21, 1995

[54] ANCHOR DEVICE

[76] Inventor: Daniel J. Chiodo, 12399 SW. 53rd St., Suite 104, Cooper City, Fla. 33330

[21] Appl. No.: 269,747

[22] Filed: Jul. 1, 1994

[51] Int. Cl.[6] ..... E04B 1/38

[52] U.S. Cl. ..... 52/713; 52/295; 52/698; 52/297

[58] Field of Search ..... 52/295, 713–715, 52/297, 698

[56] References Cited

U.S. PATENT DOCUMENTS

| | | | |
|---|---|---|---|
| 1,423,991 | 7/1922 | Brooks . | |
| 2,013,101 | 9/1935 | Inglee | 72/101 |
| 2,182,579 | 12/1939 | Bolton et al. | 72/101 |
| 2,191,979 | 2/1940 | Bierbach | 72/101 |
| 2,383,544 | 8/1945 | Guimont | 72/77 |
| 3,413,773 | 12/1968 | Fitzgerald | 52/713 |
| 3,422,585 | 1/1969 | Dismukes | 52/713 |
| 3,750,360 | 8/1973 | Kingston | 52/714 |
| 3,963,210 | 6/1976 | Macklin | 52/295 X |
| 3,998,026 | 12/1976 | Allen | 52/714 |
| 4,096,677 | 6/1978 | Gilb | 52/297 |
| 4,199,908 | 4/1980 | Teeters | 52/295 |
| 4,329,826 | 5/1982 | Flogaus et al. | 52/295 X |
| 4,387,543 | 6/1983 | Tschan et al. | 52/295 |
| 4,527,375 | 7/1985 | Braginetz | 52/712 |
| 4,875,319 | 10/1989 | Hohmann | 52/713 X |
| 4,910,934 | 3/1990 | Hennings | 52/293 |
| 4,924,648 | 5/1990 | Gilb et al. | 52/297 |
| 4,995,206 | 2/1991 | Colonias et al. | 52/297 |
| 5,375,384 | 12/1994 | Wolfson | 52/295 |

*Primary Examiner*—Carl D. Friedman
*Assistant Examiner*—Beth A. Aubrey
*Attorney, Agent, or Firm*—Oltman and Flynn

[57] ABSTRACT

An anchoring apparatus is provided for securing a beam to a structural member, including a first vertical support having a top end and a bottom end, a second vertical support generally parallel to the first vertical support having a top end and a bottom end, wherein the bottom end of the first vertical support is affixed to the bottom end of the second vertical support. The anchoring apparatus further includes a structural member formed from concrete for engaging the first and the second vertical supports, wherein the bottom ends of the first and the second vertical supports form an engaging portion for insertion into the concrete member before said concrete cures, to anchor said engaging portion to the concrete. The anchoring apparatus further includes a first plate having parallel slits sized to allow each vertical support to pass therethrough, the first plate positioned generally perpendicular to the first and the second vertical supports at a location adjacent to the top ends of the first and the second vertical supports, wherein the first plate is positioned to one side of a beam, a second plate having parallel slits sized to allow each vertical support to pass therethrough, the second plate positioned parallel to the first plate, wherein the second plate is positioned to a second side of the beam.

11 Claims, 2 Drawing Sheets

ANCHOR DEVICE

This invention is an improvement over the invention of U.S. Pat. No. 5,307,603 of the present inventor.

BACKGROUND OF THE INVENTION

1. Field of the Invention

The present invention relates generally to the field of anchoring devices for securing structural building members together, and more specifically to an anchoring device for securing the bottom member of a truss to the top of a wall.

2. Description of the Prior Art

There have long been anchoring devices for securing beams to concrete structural members, and alternatively to perpendicular beams. The concrete anchors have often been large bolts, each bent at a right angle and placed in concrete prior to curing. These bolts are typically heavy and expensive, concentrate the anchoring load on a single line, and fail to provide a secure and convenient coupling structure for attachment to a beam. The perpendicular beam anchors are typically straps and truss plates with ends bent a quarter turn relative to each other around their longitudinal axes to present properly oriented faces for nailing onto perpendicular beams. A problem with these straps and truss plates is that they only attach to one face of each beam, so that two of them must be used to achieve balanced and secure anchoring. The additional number of skilled man hours necessary to fasten two separate anchors to each beam makes this option expensive. Another problem with straps in particular is that they can pivot on their fasteners and permit a dangerous range of play between the beams.

It is thus an object of the present invention to provide an anchoring device for joining two perpendicular members together, which fastens to two faces of at least one member for secure and economical connection.

It is another object of the present invention to provide such an anchoring device which includes a coupling structure for easy and fast attachment to the members.

It is still another object of the present invention to provide such an anchoring device which has multiple, spaced apart concrete anchoring elements for a more secure, distributed load.

It is another object of the present invention to provide such an anchoring device which is inexpensive to manufacture.

It is still another object of the present invention to provide an anchoring device that can meet building code standards of at least 2,100 psi for anchoring structural beams to structural members such as concrete.

SUMMARY OF THE INVENTION

The present invention accomplishes the above-stated objects, as well as others, as may be determined by a fair reading and interpretation of the entire specification.

A preferred embodiment is disclosed for securing a beam to a structural member such as concrete. In this embodiment, the anchoring apparatus includes a first vertical support having a top end and a bottom end, a second vertical support generally parallel to the first vertical support having a top end and a bottom end, wherein the bottom end of the first vertical support is connected to the bottom end of the second vertical support. The anchoring apparatus further includes a structural member formed from concrete for engaging the first and the second vertical supports, wherein the bottom ends of the first and the second vertical supports form an engaging portion for insertion into the concrete member before said concrete cures to anchor said engaging portion to the concrete. The anchoring apparatus further includes a first plate having parallel slits sized to allow each vertical support to pass therethrough, the first plate positioned generally perpendicular to the first and the second vertical supports at a location adjacent to the top ends of the first and the second vertical supports, wherein the first plate is positioned to one side of a beam, a second plate positioned parallel to the first plate, wherein the second plate is positioned to a second side of the beam. The anchoring apparatus further optionally includes bolts and nuts for attaching the first plate to the second plate. The first and second vertical supports are formed from one piece which is bent at a middle portion, wherein the bent portion is inserted in the uncured concrete.

Further objects and advantages of this invention will be apparent from the following detailed description of a presently preferred embodiment which is illustrated schematically in the accompanying drawings.

DETAILED DESCRIPTION OF THE PREFERRED EMBODIMENTS

Figure 2:
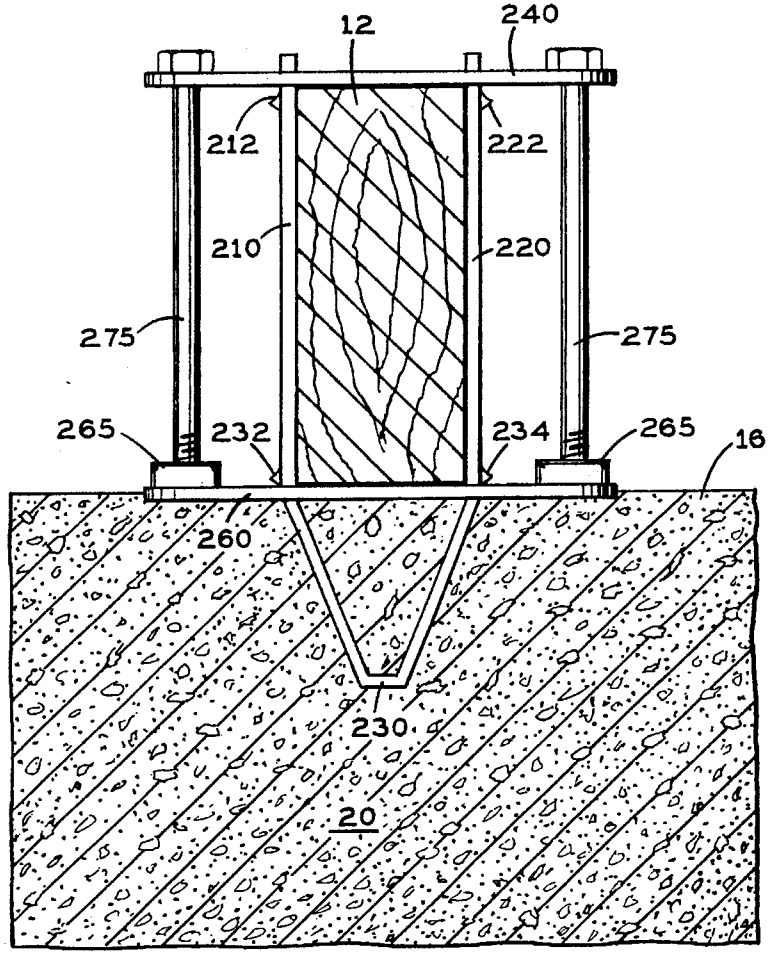
FIG. 2 is a side view of part of a truss and truss supporting wall, illustrating the preferred embodiment of FIG. 1 along arrow A and installed to connect the truss to the concrete top edge of the wall.

Before explaining the disclosed embodiments of the present invention in detail it is to be understood that the invention is not limited in its application to the details of the particular arrangement shown since the invention is capable of other embodiments. Also, the terminology used herein is for the purpose of description and not of limitation.

Reference is now made to the drawings, wherein like characteristics and features of the present invention shown in the various Figures are designated by the same reference numerals.

Figure 1:
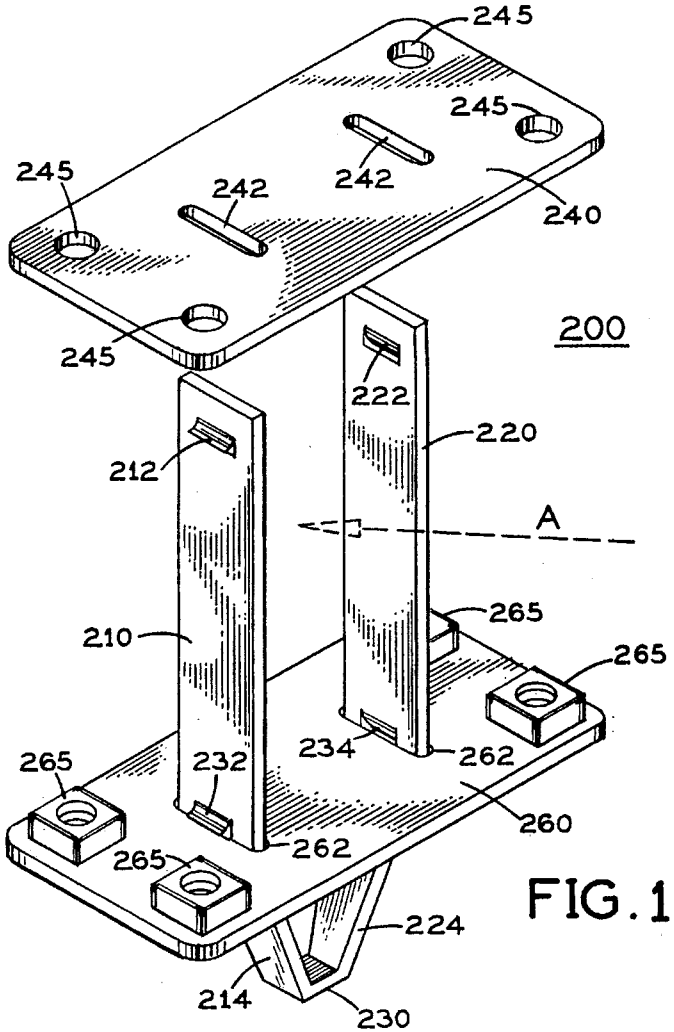
FIG. 1 is a perspective view of an anchor device for securing a beam to a concrete member.

Referring to FIGS. 1 and 2, a preferred embodiment of a device 200 is disclosed for securing structural building members together. This embodiment can be used for securing the bottom beam 12 of a roof truss to a concrete top edge 16 of a wall member 20. The recited uses for the embodiment is merely exemplary, however, and many other uses are contemplated.

Referring to FIG. 1, vertical support members 210 and 220 are connected at their lower ends at 214 and 224 respectively by such methods including but not limited to welding, soldering or the like. Alternatively, vertical support members 210 and 220 are formed from a single piece where the mid-section of that piece is bent at point 230. Top plate 240 includes slits 242 sized to fit vertical support members 210 and 220 therethrough. Slits 242 can be forced over tabs 212 and 222 to allow tabs 212 and 222 to hold plate 240 down on beam 12. Optionally, through-holes 245 are formed in top plate 240 for use with fasteners such as the nuts 265 which will be discussed later. Bottom plate 260 is similar to top plate 240, and also includes slits 262 sized to fit vertical support members 210 and 220 therethrough and to slide over tabs 212 and 222 and also tabs 232 and 234. These tabs yield resiliently enough to allow plates 240 and 260 to be passed over them and then will spring back. Nuts 265 are attached in bottom plate 260.

FIG. 2 is a side view of part of a truss beam 12 and a truss supporting concrete wall member 20, illustrating the preferred embodiment 200 of FIG. 1 along arrow A and installed to connect the truss beam 12 to the concrete top edge 16 of the wall member 20. Connected or bent portion 230 is inserted into uncured concrete at wall top edge 16 to anchor bottom plate 260 to wall member 20. Bottom plate 260 is positioned to allow vertical supports 210 and 220 and tabs 212, 222, 232 and 234 to pass through slits 262, allowing bottom plate 260 to rest on top edge 16 of wall member 20. Tabs 232 and 234 hold plate 260 down. The interior space created by generally parallel vertical supports 210 and 220 receives between them a truss bottom beam 12. Top plate 240 is positioned to allow vertical supports 210 and 220 to pass through slits 242 and over tabs 212 and 222. It is held down by the tabs 212 and 222. Finally, bolts 275 are inserted into through-holes 245 and screwed into nuts 265 to fixably secure beam 12 to concrete wall member 20.

Figure 3:
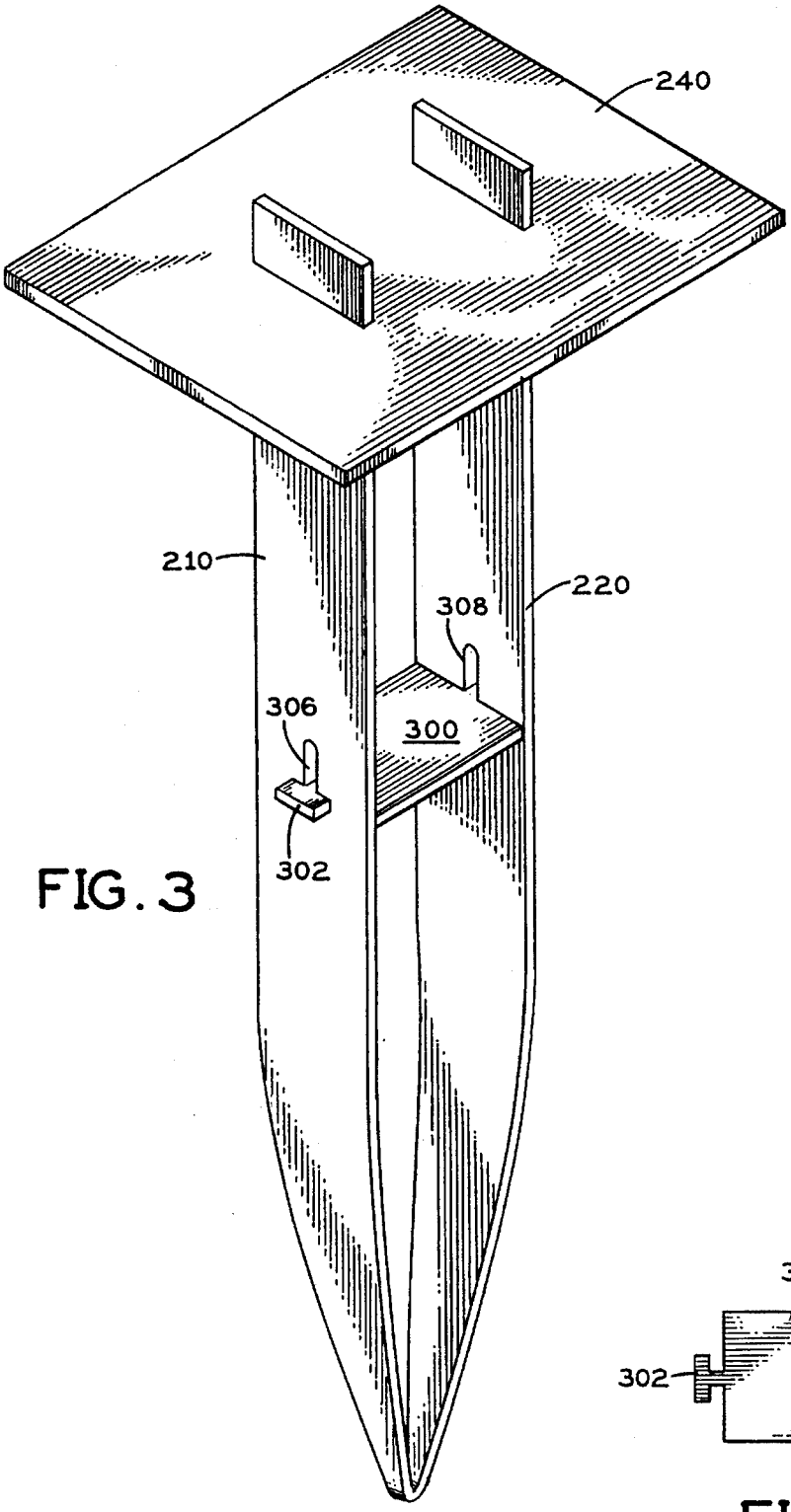
FIGS. 3, 4 and 5 are schematic views of a modification of the device of FIGS. 1 and 2.
Figure 5:
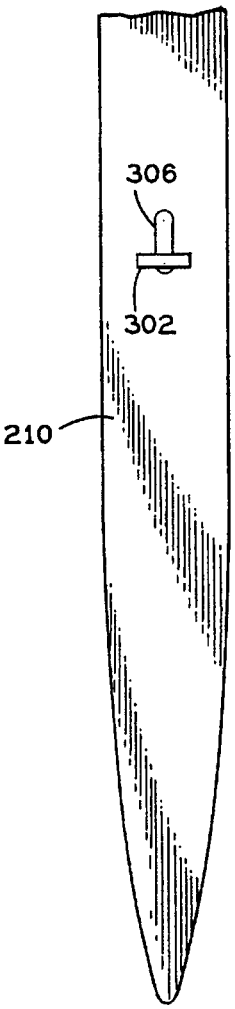
Figure 4:
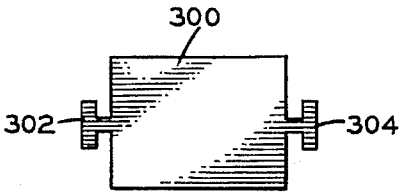

FIGS. 3–5 show a modification wherein a locking plate 300 is inserted between vertical support members 210 and 200 to rest on top of the concrete. The locking plate has lugs 302 and 304 projecting from opposite sides thereof, and these lugs are inserted through vertical slots 306 and 308 in the vertical support members. The locking plate 300 and lugs 302 and 304 are held in a vertical position while the lugs are inserted through slots 306 and 308 and are then turned to the horizontal position shown in FIG. 3.

In FIG. 3 the top plate 240 is shown as it is being placed on the vertical support members. It is then slid down the support members until it passes over the upper tabs 212 and 222 shown in FIG. 1 but not in FIG. 3. The bolts are omitted in FIG. 3.

While the invention has been described, disclosed, illustrated and shown in various terms of certain embodiments or modifications, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. An anchoring apparatus for securing a beam to a structural member, comprising:

a first vertical support having a top end and a bottom end;

a second vertical support generally parallel to the first vertical support having a top end and a bottom end, wherein the bottom end of the first vertical support is affixed to the bottom end of the second vertical support for insertion in concrete;

a structural member for engaging the first and the second vertical supports;

a first plate having parallel slits sized to allow each vertical support to pass therethrough, the first plate positioned generally perpendicular to the first and the second vertical supports at a location adjacent to the top ends of the first and the second vertical supports, wherein the first plate is positioned to one side of a beam; and a second plate positioned parallel to the first plate, wherein the second plate is positioned to a second side of the beam.

2. The anchoring apparatus of claim 1, wherein said structural member is a concrete member.

3. The anchoring apparatus of claim 2, wherein the first and the second vertical supports are formed from one piece.

4. The anchoring apparatus of claim 3, wherein the one piece is bent to form an engaging portion for insertion into the concrete member before said concrete cures to anchor said engaging portion to the concrete.

5. The anchoring apparatus of claim 1, further comprising:

fastening means for attaching the first plate to the second plate.

6. The anchoring apparatus of claim 5, wherein the fastening means includes:

bolts and nuts, wherein holes in alignment in both the first and second plate allow the bolts to pass therethrough, wherein tightening the bolts fixably secures the beam to the apparatus.

7. The anchoring apparatus of claim 1, including tabs on said first and second vertical supports for holding down said first plate.

8. The anchoring apparatus of claim 7, including further tabs on said vertical supports for holding said bottom plate down.

9. The anchoring apparatus of claim 1 wherein said second plate has lugs on opposite sides thereof and said first and second vertical supports have slots which receive said lugs.

10. An anchoring apparatus for securing a beam to a structural member, comprising:

a first vertical support having a top end and a bottom end;

a second vertical support generally parallel to the first vertical support having a top end and a bottom end, wherein the bottom end of the first vertical support is connected to the bottom end of the second vertical support;

a structural member formed from concrete for engaging the first and the second vertical supports, wherein the bottom ends of the first and the second vertical supports form an engaging portion for insertion into the concrete member before said concrete cures, to anchor said engaging portion to the concrete;

a first plate having parallel slits sized to allow each vertical support to pass therethrough, the first plate positioned generally perpendicular to the first and the second vertical supports at a location adjacent to the top ends of the first and the second vertical supports, wherein the first plate is positioned to one side of a beam; and a second plate having parallel slits sized to allow each vertical support to pass therethrough, the second plate positioned parallel to the first plate, wherein the second plate is positioned toga second side of the beam.

11. The anchoring apparatus of claim 10, wherein the first and the second vertical supports are formed from one piece.

* * * * *